United States Patent [19]

Nakanose et al.

[11] 3,979,815

[45] Sept. 14, 1976

[54] METHOD OF SHAPING SHEET METAL OF INFERIOR FORMABILITY

[75] Inventors: Megumi Nakanose, Kokubunji; Tsuneo Kakimi; Michiyoshi Shiraishi, both of Tokyo, all of Japan

[73] Assignee: Nissan Motor Co., Ltd., Yokohama, Japan

[22] Filed: July 11, 1975

[21] Appl. No.: 595,244

[30] Foreign Application Priority Data

July 22, 1974 Japan ..... 49-83905

[52] U.S. Cl. ..... 29/423; 29/187.5; 29/421 R; 29/DIG. 45

[51] Int. Cl.[2] ..... B23P 17/00

[58] Field of Search ..... 29/DIG. 45, 423, 424, 29/421 R, 180 E, 187.5, 187; 72/47, 700

[56] References Cited

UNITED STATES PATENTS

| | | | |
|---|---|---|---|
| 3,122,423 | 2/1964 | Hessler | 29/187.5 |
| 3,135,045 | 6/1964 | Schane | 29/423 X |
| 3,263,319 | 8/1966 | Tifft et al. | 29/423 |
| 3,373,480 | 3/1968 | Fuchs, Jr. | 29/421 R |
| 3,566,661 | 3/1971 | McCafferty et al. | 29/423 X |

*Primary Examiner*—Victor A. DiPalma
*Attorney, Agent, or Firm*—Frank J. Jordan

[57] ABSTRACT

In regard to sheet metals of inferior formability as typified by titanium alloys, each end face of a blank is covered with a cover plate of a metal which surpasses the blank material in formability, and the covered blank is subjected to a usual shaping operation in which the steps of heating the blank and pressing the heated blank are cycled a plurality of times, so that the blank can be protected against contamination attributable to exposure of the hot blank to the atmosphere and hence saved from having a large margin in the thickness thereof. A lubricant layer is preferably formed between the blank and each cover plate for a further improvement on the formability.

8 Claims, 4 Drawing Figures

METHOD OF SHAPING SHEET METAL OF INFERIOR FORMABILITY

This invention relates to a method of shaping a sheet metal, and more particularly to an improved method suitable for shaping a sheet metal of comparatively inferior formability.

Difficulties arise in a sheet metal shaping operation such as a press forming process or cupping process if the metal is of a comparatively poor or inferior formability as typified by titanium alloys and the operation is for the production of a shaped article which is either complicated in shape or large in height compared with the width of a blank. In a currently prevailing pressing process with such a blank material and for such a shaped article, two successive steps of heating a blank to a considerably high temperature and pressing the heated blank while hot are cycled a plurality of times, more than ten times in many cases. The heating of the blank is expected to remedy poor formability of the material to a certain extent, and the heating temperature must be determined taking into account an inevitable temperature drop during the pressing step due to heat transfer to the outside mainly by conduction through a die, blank holder and punch. For example, the heating temperature ranges usually from 1000° to 1100°C when a titanium alloy is press formed into a hemispherically shaped article.

The shaping operation with, e.g., a titanium alloy blank suffers the following disadvantages when the blank is heated repeatedly to such high temperatures.

1. On both the sides of the blank, contaminated layers containing therein hidrides and other unwanted compounds are formed to a considerable thickness since titanium exhibits remarkably enhanced chemical affinities for various constituents of the environmental atmosphere.
2. The grain size of the material becomes larger or coarser, and mechanical properties of the material or the shaped article are injured.
3. The blank must have an excessively large thickness so that the contaminated layers may be removed by machining after the pressing process.
4. The blank thickness must be more than enough to meet the above requirement (3) in preparation for extra machining operations which will be needed to finish the shaped article into a final product due to lack of the accuracy in the shape and dimensions of the shaped article resulting from increase in the blank thickness.
5. Formability of the blank goes wrong as the thickness increases and, hence, further difficulties arise in the shaping operation. Besides, it is difficult to obtain a titanium alloy sheet of a very large thickness and uniform quality. Furthermore, the use of an excessively thick blank results in lowering of the weight ratio of the finished product to the blank and hence increase in the production cost.

As a practical example, the thickness of a titanium alloy blank of 1600 mm in diameter for the production of a hemispherical article of 450 mm in radius and 3 mm in the shell thickness was determined as follows. When the shaping operation was accomplished by cycling 12 times the steps of heating the blank to 1000° to 1100°C and pressing the heated blank, the aforementioned contaminated layers were formed on both the sides of the shaped article attaining a depth of 3 to 5 mm from each surface. Apart from development of the contaminated layers, the shaping operation caused the thickness of the blank to decrease by about 25% at the maximum. Such decrease in the thickness was mainly attributable to the stretching of the blank on the outer side of the shaped article, so that only a disc-like region lying between the middle section and the other side of the initial blank must be turned into the finished product by machining operations subsequently to the repeated pressing steps. Taking into account all of these data and factors, the blank was made as thick as about 25 mm.

It is a general object of the present invention to remove the described disadvantages inherent to conventional sheet metal shaping operations at elevated temperatures with metals of comparatively poor formability.

More particularly it is an object of the invention to provide an improved method of shaping a sheet metal of a comparatively poor formability at elevated temperatures, which method causes practically no contamination of the surface regions of a blank and allows the thickness of the blank to be less than usual values for conventional methods.

It is another object of the invention to provide a method for the described shaping operation, which method can minimize and/or regulate the temperature change of the heated blank during the shaping operation.

It is still another object of the invention to provide a method for the described shaping operation, which method can be completed through less repetition of pressing and heating procedures than conventional methods with improved precisions in the dimensions of the shaped article and less tendency of causing the grain size of the material to become coarser.

According to a method of the invention, the top and bottom end faces of a blank of a sheet metal which metal is of a comparatively inferior formability are initially covered each with a cover plate of a different metal which surpasses the material of the blank in formability, and the blank is subjected to known steps of heating the blank and exerting a load on the heated blank with the cover plate on each end face thereof.

The metal for the cover plates is preferably either a mild steel or a stainless steel, and a layer of a lubricant is preferably formed sandwiched between each cover plate and each end face of the blank.

Other features and advantages of the invention will be fully understood from the following detailed description of preferred embodiments thereof with reference to the accompanying drawings, in which.

Figure 1:
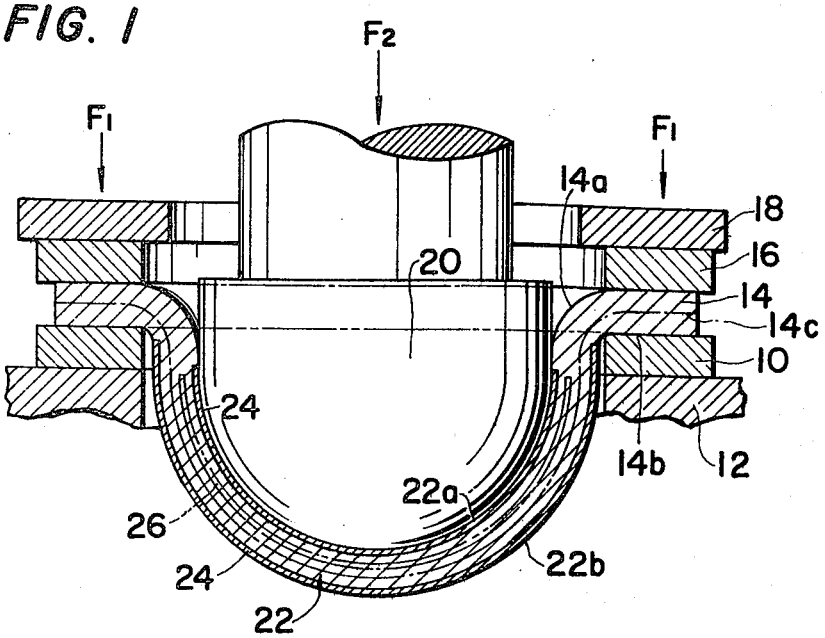
FIG. 1 is a schematic and sectional side view of a sheet metal shaping apparatus for the explanation of a method of shaping a circular blank into a hemispherically curved article.

FIG. 1 is presented for the explanation of an example of conventional sheet metal shaping operations. An annular die 10 is mounted on a support 12. A disc-shaped blank 14 is placed on the die 12 and secured thereto at a controlledly variable pressure $F_1$ by means of a blank holder 16 and a pressure plate 18. The blank 14 is heated in advance and then subjected to bending or drawing process which consists of pressing the blank 14 while hot with a hemispherical male die or punch 20 a plurality of times each time at a controlledly variable load $F_2$. Both the inner and outer end faces 22*a* and 22*b* (which correspond to the top and bottom end faces 14*a* and 14*b* of the blank 14, respectively) of a hemispherically formed article 22 are contaminated as described hereinbefore due to exposure to the atmosphere at elevated temperatures during the pressing procedures. The contamination arises not only on the end faces 22*a* and 22*b* but also in stratiform regions 24 each extending inwards, e.g., a few millimeters deep from each end face 22*a* or 22*b*. The shaped article 22 is thereafter subjected to machining operations to give lastly a thin-walled and hemispherical finished article 26 (indicated by a phantom line in FIG. 1). As explained hereinbefore, the finished article 26 is obtained from an inside region (no numeral) of the shaped article 22 lying between the inner face 22*a* and a central horizontal plane 14*c* of the initial blank 14 taking into account the ununiformity in the thickness reduction of the blank 14.

Figure 2:
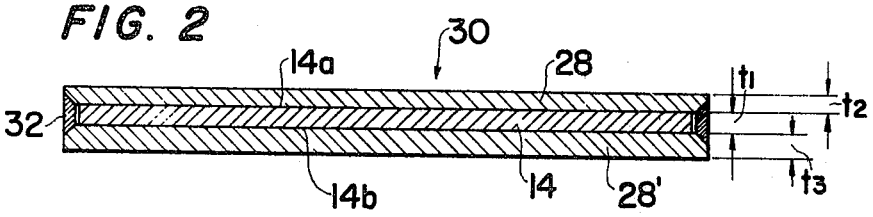
FIG. 2 is a sectional side view of a blank for the same method, the end faces of which are covered with cover plates according to the invention.

Referring to FIG. 2, both the top and bottom end faces 14*a* and 14*b* of the blank 14 are covered with cover plates 28 and 28' of a sheet metal, respectively. The sheet metal for these covers 28 and 28' is selected from conventional metals which are softer or milder and easier to shape than the metal material of the blank 14, and preferably selected from mild steels such as structural carbon steels and stainless steels. The thickness of the covers 28, 28' is determined principally such that the covers 28, 28' may not be cracked or split when subjected together with the sandwiched blank 14 to a pressing process for forming the intended article 22. These covers 28, 28' are circular in plan shape, i.e., similar to the blank 14, with a slightly large diameter than the blank 14 and joined with each other by means of an annular welded-joint 32 which fills the peripheral gap between the two covers 28, 28'. Thus both the end faces 14*a*, 14*b* of the blank 14 are completely isolated from the ambient atmosphere. The thus constructed blank-cover assembly 30 is thereafter heated and pressed while hot similarly to the bare or usual blank 14 as explained with reference to FIG. 1. When the pressing process is completed, the deformed covers 28, 28' are removed and the bared shaped article 22 is subjected to subsequent machining operations if necessary.

A shaping operation by the use of the blank-cover assembly 30 according to the invention has fundamentally the following advantages.

1. No contaminated layer 24 is formed on or in the shaped article 22 since the blank 14 is isolated from the atmosphere during heating and pressing processes. Accordingly the thickness of the blank 14 can be lessened by a value corresponding to the total thickness of the contaminated layers 24 developed in the case of using the bare blank 14.
2. Formability of the blank 14 can be improved due to the lessened thickness. A natural increase in the thickness by the covers 28, 28' has not a significant influence on the formability so long as the covers 28, 28' are made of the above described easy-to-form sheet metal.
3. The rate of temperature drop of the blank 14 during the pressing process lowers owing to a temperature maintainance effect of the covers 28, 28'. Furthermore, this rate can be regulated by adequate choice of the thickness of the covers 28, 28'.
4. The shaping operation can be completed by cycling less times the steps of heating and pressing at lower temperatures owing to the above advantageous features. As a result, the shaped article 22 is of improved qualities and particularly characterized by superior precision in the dimensions and finer grain sizes of the material compared with the similar articles 22 formed by conventional methods.

The two sheets of cover plates 28 and 28' may have the same thickness, but it is preferable for attaining highest precision in the dimensions of the shaped article 22 that the bottom side cover 28', which will undergo a much larger extent of stretching than the top side cover 28 in the pressing process, has a thickness $t_3$ larger than a thickness $t_2$ of the other cover 28 as illustrated in FIG. 2 (wherein the symbol $t_1$ indicates the thickness of the blank 14).

To further improve the formability of the covered blank 30, it is preferable to form a thin layer of a lubricant between the blank 14 and each cover 28 or 28' so that the blank 14 may be allowed to slip relatively to the covers 28, 28' during a pressing process.

Figure 3:
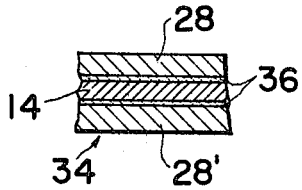
FIG. 3 is a similar but fragmentary view of the same blank showing a solid lubricant layer between the blank and each over plate as a modified embodiment of the invention.

In a modification 34 which is shown fragmentarily in FIG. 3, both the top and bottom end faces of the blank 14 are coated with a thin layer 36 of a lubricant powder prior to assembling with the covers 28, 28'. Preferred examples of the solid lubricants for these layers 36 are graphite and molybdenum disulfide powders.

Figure 4:
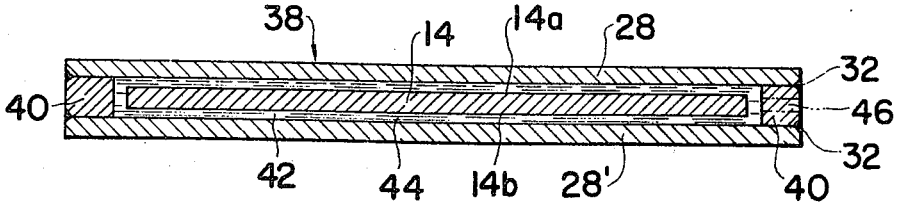
FIG. 4 is a similar view of the same blank, but shows a differently modified embodiment of the invention, in which the cover plates are arranged differently and the blank is surrounded by a liquid lubricant.

FIG. 4 shows a differently modified blank-cover assembly 38 which confines therein a different type of lubricant. In this assembly 38, the covers 28 and 28' are arranged at a distance from the top and bottom faces 14*a* and 14*b* of the blank 14, respectively, and a hollow cylindrical spacer 40 preferably of the same material as the covers 28, 28' is sandwiched between and welded to the covers 28, 28'. The spacer 40 has an inner diameter larger than the diameter of the blank 14. Consequently a closed space 42 is defined by the covers 28, 28' and the spacer 40 around the blank 14. Alternatively to the spacer 40, at least one of the covers 28, 28' may be shaped into a bottomed and open-top cylinder. The thus formed space 42 is filled with a filler 44 which is either a liquid lubricant or a solid which melts at a temperature below the minimum heating temperature in the subsequent shaping operation. Various oils serve as the liquid lubricant or the filler 44. Useful solid fillers 44 are roughly divided into three groups: the first group is various fats, the second is metals of comparatively low melting points such as tin, lead, aluminum and zinc including their alloys and mixtures, and the third is nonmetallic inorganic materials which serve as salt baths as exemplified by a chloride glass. The solid filler 44 may be enclosed in the assembly 38 simultaneously with the blank 14. A hole 46 is formed through the wall of the spacer 40 as shown by the phantom line in FIG. 4 when the filler 44 is a liquid, and the filler is poured into the space 42 after the blank 14 is enclosed in the assembly 38. The hole 46 is thereafter tamped by means of weld or with a plug (no numeral). Even when the filler 44 is a solid substance, it is preferable to melt the filler 44 preliminarily and pour the melted filler 44 into the space 42 through the hole 46 because the space 42 can be filled voidlessly with the filler 44 by this method.

When the thus constructed assembly 38 is heated for the hereinbefore described pressing process, the blank 14 in its entirety is surrounded by the liquid or liquefied filler 44 which is confined in the assembly 38 under pressure resulting from thermal expansion thereof. Accordingly the load $F_2$ which is exerted on the top side cover 28 by the punch 20 is easily and uniformly transmitted to the other cover 28' via the filler 44. As a result, both the bottom side cover 28' and the space 42 are deformed generally similarly to the top side cover 28, and the blank 14 is shaped smoothly at a uniformly distributed forming pressure with satisfactory lubrication by the filler 44.

In addition to the thus improved formability, the rate of temperature drop of the blank 14 further lowers by the use of this assembly 38 since the liquid or liquefied filler 44 has a lower coefficient of thermal conductivity than the metal covers 28, 28'.

Examples of metal materials which are hard to form and can be formed with good results by a method of the invention are beryllium, beryllium alloys and maraging steels other than titanium alloys.

The invention will be further illustrated by the following examples.

EXAMPLE 1

The blank 14 was 1600 mm in diameter and of a titanium alloy composed of about 6% Al, about 4% V and the balance Ti. This blank 14 was shaped into the hemispherical article 22 which was 450 mm in radius and an intermediate product for a spherical rocket motor chamber. The blank 44 was covered with the covers 28, 28' of a mild steel in accordance with FIG. 3 utilizing a finely powdered graphite as the lubricant 36 and subjected to the pressing process illustrated in FIG. 1. The thickness $t_1$, $t_2$ and $t_3$ of the blank 44 and the covers 28, 28' were 10, 10 and 15 mm, respectively, and the pressing process was completed by the following 7 steps.

| Step No. | Heating temperature (°C) | Load $F_1$ on blank holder 16 (kg/cm²) | Load $F_2$ on punch 20 (kg/cm²) |
|---|---|---|---|
| 1st. | 680 | 30 | 32 |
| 2nd. | 840 | 30 | 55 |
| 3rd. | 880 | 30 | 65 |
| 4th. | 800 | 30 | 80 |
| 5th. | 860 | 35 | 110 |
| 6th. | 750 | 140 | 120 |
| 7th. | 800 | 135 | 125 |

The shaped article 22 was neither injured nor contaminated, and the maximum reduction in the thickness $t_1$ was by 12% of the initial thickness of the blank 14.

EXAMPLE 2

The same blank 14 was formed into the similar article 22 as in Example 1 by the use of the assembly 38 of FIG. 4. The covers 28, 28' were similar to those which were used in Example 1 both in the material and thicknesses. The spacer 40 was made of the same mild steel and had a height or thickness of 15 mm (accordingly the mean distance between the blank 14 and the covers 28, 28' was 2.5 mm), and the space 42 was filled with a 40/60 tin-lead solder. The pressing process was generally similar to the process of Example 1 except that the following temperature and load values were employed.

| Step No. | Heating temperature (°C) | Load $F_1$ on blank holder (kg/cm²) | Load $F_2$ on punch (kg/cm²) |
|---|---|---|---|
| 1st. | 680 | 30 | 32 |
| 2nd. | 850 | 28 | 54 |
| 3rd. | 850 | 30 | 65 |
| 4th. | 680 | 28 | 80 |
| 5th. | 850 | 38 | 100 |
| 6th. | 680 | 135 | 120 |
| 7th. | 800 | 130 | 120 |

The resulting hemispherical article 22 was neither injured nor contaminated at all, and the maximum reduction in the thickness $t_1$ was by 10%.

It is expected that the pressing process for the hemispherical article 22 with the blank 14 of these Examples may be accomplished by still less times of steps and at lower temperatures if the relationship between the design of assembly 34 or 38 and the loads $F_1$ and $F_2$ are studied more minutely.

The above description was concerned exclusively with a press-forming method, but the method of the invention is applicable to other types of metal forming processes such as, e.g., spinning and stamping with good results.

We claim:

1. A method of shaping a sheet metal of a comparatively inferior formability, comprising the steps of:

enclosing a blank of the sheet metal in an air-tight sealed holder of another metal surpassing the sheet metal in formability, said holder including a top plate and a bottom plate arranged parallel to the top and bottom end faces respectively of said blank, said holder also including a frame surrounding the side of said blank and connecting said top and bottom plates, said frame having a height greater than the thickness of said blank and a cross-sectional area larger than the end face area of said blank to thereby have a space in said holder around said blank;

filling said space with a filler capable of being in a liquid phase at least at an elevated temperature;

heating the assembly of said holder, blank, and filler to a temperature above said elevated temperature; and exerting a load on said top plate of the heated assembly so that said load is transmitted to said blank.

2. A method as claimed in claim 1 wherein said another metal is selected from the group consisting of mild steels and stainless steels.

3. A method as claimed in claim 1 wherein said filler is selected from the group consisting of oils and fats.

4. A method as claimed in claim 1 wherein said filler is selected from the group consisting of tin, lead, aluminum, zinc, their mixtures and their alloys.

5. A method as claimed in claim 1 wherein said filler is a chloride glass.

6. A method as claimed in claim 1 wherein said bottom plate has a larger thickness than said top plate.

7. A method as claimed in claim 1 wherein said top and bottom plates and the outer side of said frame are similar in contour to said blank.

8. A method as claimed in claim 1 wherein said sheet metal blank is a titanium alloy.

* * * * *